US009797663B2

(12) United States Patent
Day et al.

(10) Patent No.: US 9,797,663 B2
(45) Date of Patent: Oct. 24, 2017

(54) HEAT EXCHANGER AND SHEET FOR THE EXCHANGER

(75) Inventors: Alan Day, Thillois (FR); Nicolas Vallee, Bazancourt (FR); Olivier Schild, Guignicourt (FR); Alain Bauerheim, Jonchery-sur-vesle (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 465 days.

(21) Appl. No.: 13/638,321

(22) PCT Filed: Mar. 28, 2011

(86) PCT No.: PCT/EP2011/054753

§ 371 (c)(1),
(2), (4) Date: Jan. 4, 2013

(87) PCT Pub. No.: WO2011/120934

PCT Pub. Date: Oct. 6, 2011

(65) Prior Publication Data

US 2013/0092360 A1 Apr. 18, 2013

(30) Foreign Application Priority Data

Mar. 31, 2010 (FR) ..... 10 52406

(51) Int. Cl.

| | |
|---|---|
| ***F28F 3/08*** | (2006.01) |
| ***F28D 9/00*** | (2006.01) |
| *F28D 21/00* | (2006.01) |

(52) U.S. Cl.

CPC ..... *F28F 3/08* (2013.01); *F28D 9/0043* (2013.01); *F28D 9/0056* (2013.01);
(Continued)

(58) Field of Classification Search

CPC ..... F28F 2265/26; F28F 9/001; F28F 9/002; F28D 9/0006
(Continued)

(56) References Cited

U.S. PATENT DOCUMENTS 3,129,931 A * 4/1964 Stookey ..... 165/82
3,237,688 A * 3/1966 Huggins ..... 165/152
(Continued)

FOREIGN PATENT DOCUMENTS

EP 1 830 048 A1 9/2007
FR EP 0647824 * 4/1995 ..... F28D 1/0333
(Continued)

OTHER PUBLICATIONS

Martins, FR2855604TRANS (English Translation), Dec. 2004.*
(Continued)

*Primary Examiner* — Justin Jonaitis
*Assistant Examiner* — Eric Ruppert
(74) *Attorney, Agent, or Firm* — Osha Liang LLP

(57) ABSTRACT

The invention relates to a heat exchanger comprising a casing (2) inside which is housed, and fastened by brazing, a heat exchange assembly (3) comprising a stack of heat exchange plates, each plate (4) having at least one edge (14) for brazing to the casing (2). The heat exchanger is characterized by the fact that it includes means, called unfastening means (20, 21, 22, 23), designed to prevent the casing from being brazed to at least a portion of the edge (14) of at least one end plate (4E) of the stack (3). By virtue of the invention, the heat exchanger is more flexible and absorbs thermal stresses better.

22 Claims, 2 Drawing Sheets

(52) U.S. Cl.
CPC .. *F28D 2021/0082* (2013.01); *F28F 2265/26* (2013.01); *F28F 2275/04* (2013.01); *Y10T 428/24777* (2015.01)

(58) Field of Classification Search
USPC ..... 165/81, 82, 83, 157, 165, 166, 167
See application file for complete search history.

(56) References Cited

U.S. PATENT DOCUMENTS

| | | | | |
|---|---|---|---|---|
| 3,939,908 | A * | 2/1976 | Chartet | 165/149 |
| 4,036,289 | A * | 7/1977 | Cheng | F28F 9/0132 122/510 |
| 4,453,592 | A * | 6/1984 | Wightman | 165/82 |
| 4,903,389 | A * | 2/1990 | Wolf | 29/890.043 |
| 5,014,771 | A * | 5/1991 | Oddi et al. | 165/76 |
| 8,266,900 | B2 * | 9/2012 | Shikazono et al. | 60/320 |
| 2004/0149425 | A1 * | 8/2004 | Abiko et al. | 165/166 |
| 2007/0012424 | A1 * | 1/2007 | Kamiya et al. | 165/81 |
| 2011/0168366 | A1 * | 7/2011 | Garret | F28D 9/0043 165/148 |

FOREIGN PATENT DOCUMENTS

| | | | | |
|---|---|---|---|---|
| FR | 2855604 | * | 12/2004 | F28D 9/0043 |
| FR | 2933176 | A1 | 1/2010 | |
| WO | 2005/116436 | A1 | 12/2005 | |
| WO | 2009/156363 | A1 | 12/2009 | |

OTHER PUBLICATIONS

Laveran, EP0647824TRANS (English Translation), Apr. 1995.*
International Search Report w/translation from PCT/EP2011/054753 dated May 13, 2011 (4 pages).

* cited by examiner

HEAT EXCHANGER AND SHEET FOR THE EXCHANGER

The present invention relates to the field of heat exchangers, notably for heat engines of motor vehicles.

The present invention applies in particular to a heat exchanger used as a cooler of the turbocharging gases (optionally mixed with the recirculated exhaust gases) of a motor-vehicle heat engine, such a cooler notably making it possible to increase the density of the air at the engine inlet.

In a known manner, in order to cool the turbocharging gases, such a heat exchanger may use a coolant fluid, such as water or glycolated water that is carried and guided in an appropriate cooling circuit. Conventionally, it is what is known as a "low-temperature" cooling circuit of the vehicle.

The various mechanical stresses exerted on the exchanger by the turbocharging gases (the pressure of which is particularly high since they originate from the compressor) frequently cause a weakening of the structure of the exchanger, which may cause the appearance of leaks of the coolant fluid in the air intake circuit of the engine and severely damage the latter.

Through patent application FR-2933176 in the name of the Applicant, a heat exchanger is known of which the stiffened structure is capable of withstanding and of absorbing such mechanical stresses.

This exchanger comprises a cluster of metal sheets stacked on one another, this cluster being housed inside a casing (also called a housing) that is also metallic. The casing comprises two facing transverse walls (relative to the large dimension of the sheets) which are connected to bottom and top walls in order to form a peripheral enclosure of rectangular section around the cluster of sheets.

On the open sides of the peripheral enclosure of the casing are designed to be attached inlet and outlet manifolds which may take the form of both a cover and a distributor of inlet air for the engine and through which the turbocharging gases enter and exit the cluster of sheets.

Furthermore, the sheets of the cluster of sheets are each formed of a pair of plates that are assembled by brazing. The plates of each pair define between them first generally longitudinal circulation channels in which the glycolated water circulates. Once the sheets of the cluster have been stacked and brazed to one another, the spaces formed between the pairs of adjacent plates define second transverse channels designed to be traversed by the turbocharging gases that are to be cooled, these gases exchanging heat with the glycolated water via the plates.

In order notably to ensure a resistance to the pressure that is exerted on the structure of the heat exchanger, the longitudinal end edges of the sheets (also called "sheet heads") are secured to the two facing transverse walls of the casing by brazing.

The operation for brazing the pairs of plates together and to the walls of the casing may be carried out in a single operation by running the preassembled exchanger into a brazing oven.

In particular, the sheet heads comprise means for attachment to the casing in the form of tabs or lips, having surfaces that are substantially parallel to the transverse walls of the casing, arranged to be pressed onto them and on which is placed a brazing material. When the sheets and the walls of the casing are run into the brazing oven, the brazing material melts and binds the attachment means to the transverse walls of the casing. In this way, all of the sheets of the cluster are secured to the casing.

Such an easy connection gives the exchanger structure a great rigidity and increased resistance to the various mechanical stresses that it sustains.

The object of the present invention is notably to develop the heat exchangers of the type described above.

Accordingly, the invention relates to a heat exchanger comprising a casing inside which is housed and attached by brazing a heat-exchange cluster comprising a stack of heat-exchange sheets, each sheet comprising at least one edge for brazing to the casing, characterized in that it comprises means, called separation means, designed to prevent the brazing onto the casing of at least one portion of the edge of at least one end sheet of the stack.

Thus, by virtue of the invention, the end sheets of the stack are not secured to the casing at said sheet portions, which provides the exchanger with a relaxation of the stresses in these zones of the end sheets.

Since the sheets extend substantially in planes and are stacked on one another in a direction substantially perpendicular to these planes, the end sheets of the stack are understood to be the same one or ones situated at one or other of the ends of the stack in this stacking direction.

On this subject, it should be noted that, in the case of a cluster defined by a stack of sheets in the form of pairs of sheets, as mentioned above, connector sheets can be provided between the casing and the end sheets furnished with said separation means. In such a mode, said end sheets are thus made up of the pairs of sheets provided on one side and/or the other of the cluster defining a circulation channel for the cooling fluid.

The merit of the Applicant has been to observe that the expansion in the plane of the sheets perpendicular to the direction of the edges of the sheets (hereinafter called longitudinal expansion), on the one hand, and in the direction of the stacking of the sheets (hereinafter called transverse expansion), on the other hand, were uneven between the various sheets of the cluster. It has notably revealed that:

- the end sheets sustain the cumulative transverse expansion of the central sheets so that their transverse expansion is substantially greater than that of the central sheets; and
- the longitudinal and transverse expansions of the casing walls are both lesser and later than those of the sheets of the cluster (notably because of the generally greater thickness of the walls of the casing, physical characteristics that are intrinsic to the material of the casing and because only one side of the casing walls is exposed to the turbocharging gases), which is transferred to the longitudinal and transverse expansions of the end sheets of the cluster which are therefore closed off by the casing.

In consequence, by virtue of the present invention, the rigidity of the exchanger is reduced and its flexibility increased, generally and in particular in the zones of the separation means, which improves the absorption of mechanical stresses by the end sheets, limiting the risk of fatigue of the exchanger structure. These advantages are obtained by a separation of portions of edges which were primarily, on the contrary, intended to be secured to the casing by brazing.

The problem at the origin of the invention relates to a heat exchanger for the cooling, by glycolated water, of the turbocharging air of a heat engine of a motor vehicle. The Applicant does not, however, intend to limit the extent of its rights to this application alone since the invention applies more generally to any heat exchanger with a stack of sheets brazed to its casing, irrespective of the fluids that circulate therein.

According to one embodiment, the separation means are arranged along the whole edge of said end sheet, in other words continuously along this edge, from one end to the other of the edge.

According to one embodiment, the exchanger comprises separation means along at least one portion of the edge of a plurality of end sheets, on one and the same side and/or on two sides (for example top or bottom) of the stack. In other words, separation means may be provided:

for one or more end sheets of a first side of the stack and/or for one or more end sheets of the other side of the stack.

Moreover, separation means may be provided at one wall of the casing or at two walls of the casing (on either side of the sheets).

According to a preferred embodiment according to the invention, the separation means comprise a clearance arranged between said edge portion of sheet and the casing. Such a clearance, during brazing, prevents said end sheet from separating from the casing at said edge portion since the surfaces in question are not in contact.

This substantially limits the mechanical stresses applied to the end sheet or sheets, notably at its or their edges for brazing to the casing when the heat exchanger is operating.

Moreover, according to one embodiment in this case, the casing comprises at least one internal groove placed facing said end sheet, said clearance being arranged in said groove. Thus, the separation means are formed simply by the formation of the walls of the casing.

Preferably, the casing comprises at least as many internal grooves as ends, each of said internal grooves being arranged facing at least one of said end sheets.

According to one embodiment, since the sheets of the exchanger comprise, along at least certain of their edges, attachment means (for example in the form of tabs or lips) of predefined width designed to come into contact with the casing for being brazed to the latter, the internal groove has a width at least equal to the predefined width of said attachment means.

Moreover, preferably, since the sheets have a width parallel to the direction of their edges and perpendicular to the direction of the stack, the internal groove has a length at least equal to the width of said end sheet.

As a variant or as an addition, since the sheets have a length perpendicular to the direction of their edges and to the direction of the stack, said end sheet has a length that is shorter than that of the other sheets. By providing one or more end sheets that are shorter than the central sheets, a clearance is arranged between the casing and said end sheet or sheets, which prevents them being secured by brazing.

Irrespective of how a clearance between the edge of an end sheet and the casing is obtained, this clearance is preferably at least equal to 0.1 mm.

Moreover, according to another embodiment according to the invention, the separation means comprise at least one strip of unbrazable material arranged on said casing, which is oriented towards said cluster of sheets and placed facing said portion of edge of said end sheet.

Thus, brazing is prevented in the zone of the strip, which therefore defines the portion of edge separated from the end sheet.

According to another embodiment according to the invention, the edge portion of the sheet has no brazing material, this portion therefore not being secured to the casing during brazing.

In these two cases, the separation means are therefore simply obtained by modifications to the coating of the parts in certain zones.

According to yet another embodiment according to the invention, the sheets comprising, along at least certain of their edges, attachment means (for example in the form of tabs or lips) designed to come into contact with the casing for being brazed to the latter, said edge portion of said end sheet has no such attachment means. The separation means are thus obtained by adaptation of the structure of the sheets.

According to yet another embodiment according to the invention, all of the sheets of the stack of heat-exchange sheets comprise separation means.

The invention also relates to a sheet for the exchanger explained above, the sheet comprising at least one edge for brazing to the casing, the sheet comprising means for separation from the casing of at least one portion of its edge.

When they are arranged on the sheet, the means may for example consist of the absence of brazing material on the portion of edge of the sheet, of the absence of edge on the portion in question or of the formation of the sheet of a length shorter than that of the other sheets.

The invention will be better understood with the aid of the following description of the various embodiments of the heat exchanger of the invention, with reference to the plates of drawings attached, in which:

FIG. 1 shows schematically an exemplary embodiment of a heat exchanger 1, according to the invention, designed to cool the turbocharging air of a heat engine of a motor vehicle (not shown).

Figure 1:
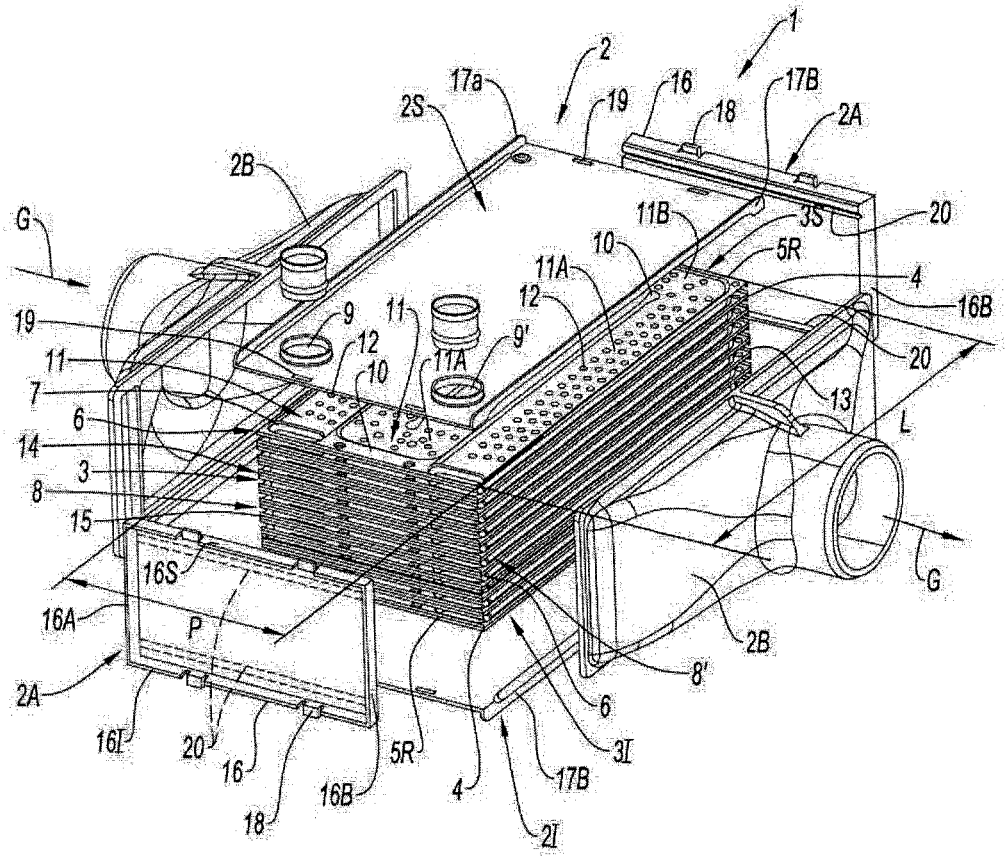
FIG. 1 is an exploded schematic view in perspective of an exemplary embodiment of a heat exchanger according to a preferred embodiment according to the invention.

In a known manner, the heat exchanger 1 comprises a metal casing 2 inside which is housed and attached by brazing a heat-exchange cluster 3 comprising a stack of metal heat-exchange sheets 4.

Each sheet 4 of the cluster 3 is generally flat (or flattened parallelepipedal) and has a length L (also called the long side), a width I (also called the short side) and a thickness e (shown in FIG. 2) in the corresponding directions, in the conventional manner. The longitudinal, lateral and transverse notions are defined respectively in relation to the direction of the length L, the direction of the width I and the direction of the thickness e of the sheets 4. Moreover, the notions of upstream and downstream are defined with respect to the direction of flow of the stream of recirculation gases in the cluster (symbolized by the arrow G).

The stacking 3 of sheets 4, superposed on one another, is carried out in a stacking direction parallel to the transverse direction e of the sheets 4 and orthogonal to their longitudinal direction L. The notions of top and bottom are defined with respect to the top and bottom sides 3I and 3S respectively of the stack 3, in the direction of the stack.

The sheets 4 of the cluster 3 are each formed by a pair of plates 5 assembled by brazing. Each plate 5, which is pressed, comprises two bosses 6 each provided with an aperture 7 allowing the inlet and outlet of a coolant fluid, for example glycolated water, originating from a low-temperature circuit of the motor vehicle.

The two respective bosses 6 of a plate 5 belonging to a sheet 4 are in communication with the two corresponding respective bosses 6 of a facing adjacent plate 5 belonging to a plate 5 of an adjacent sheet 4. The two successive and superposed assemblies of bosses 6 form respectively two distribution ducts 8, 8' that are substantially parallel to the direction of the stack. This makes it possible to establish the fluidic communication of the glycolated water between the superposed sheets 4 of the cluster 3. The coolant fluid enters the cluster of sheets through one of the two distribution ducts 8, called the inlet duct 8, by means of an inlet nozzle 9 mounted on the casing 2 and connected to the inlet duct 8; it leaves the cluster 3 through the other distribution duct 8', called the outlet duct 8', by means of an outlet nozzle 9' also mounted on the casing 2 and communicating with the outlet duct 8'.

Each plate 5 of a sheet 4 comprises a series of collars 10 designed to be joined, for example by brazing, to the collars 10 of the other plate 5 of the sheet 4. This defines the first coiled channels 11 for the circulation of the coolant fluid within each sheet 4 of the cluster 3. In the example of FIG. 1, the first channels 11 of the sheets 4 comprise longitudinal portions 11*a* connected to one another by returns 11B in the vicinity of the longitudinal ends of the sheets 4, which makes it possible to define several circulation passes for the glycolated water in each of the sheets 4.

Each plate 5 also comprises a series of disruptive bosses 12 arranged within the first channels 11 (that is to say in the various circulation passes of the latter). These disruptive bosses 12 are capable of disrupting the circulation of the glycolated water in the first channels 11, thus improving the exchange of heat between the glycolated water and the turbocharging gases to be cooled.

The spaces formed between each of the sheets define second channels 13 (FIG. 2), in the direction of the width I of the sheets 4, orthogonal to the longitudinal portions 11A of the first channels 11 and designed to be traversed by turbocharging gases to be cooled. Inside these second channels 13 are placed corrugated spacers (not shown in the figures) that are brazed to the corresponding adjacent sheets 4 in order to disrupt the flow of the stream of gases and promote the thermal exchanges. The turbocharging gases therefore circulate in the second channels 13 through the corrugated spacers in order to be cooled on contact with the walls of the plates 5 of the sheets 4 of the cluster 3.

The turbocharging gases are thus cooled by the glycolated water that initially enters the cluster 3 by means of the inlet nozzle 9, is then distributed in the various sheets 4 by the inlet duct 8, circulates in the first channels 11 in order to exchange heat with the turbocharging gases and is finally discharged from the cluster 3 of sheets through the duct 8' and the outlet nozzle 9'.

The stack 3 comprises in particular two individual connecting plates 5R, placed respectively at the ends of the bottom side 3I and top side 3S of the stack 3 and brazed respectively to the faces, turned toward the stack 3, of the bottom wall 2I and top wall 2S of the casing 2, by means of their collars 10.

Moreover, each of the two plates 5 of one sheet 4 comprises an end edge 14, or sheet head, at each of its longitudinal ends (or small sides).

The longitudinal end edges 14 of each of the plates 5 of a sheet 4 comprise an attachment tab (or lip) 15 which extends in the direction of its length, along the width I of the sheet 4 (that is to say in the lateral direction) and, in the direction of its width, along the thickness e of the sheets (that is to say in the stacking direction). The length of an attachment tab 15 corresponds to the width I of the plate 5 to which it belongs.

At one edge 14 of a sheet 4 of the cluster 3, the attachment tab 15 of the top plate 5 of the sheet 4 extends in the direction of the top side of the stack 3, while that of the matching bottom plate extends in the direction of the bottom side of the latter.

Thus, each sheet 4 of the cluster 3 comprises, at each of its longitudinal end edges 14, a pair of attachment tabs 15 which forms means for attachment to the casing, of predefined width.

The cluster 3 of sheets is housed inside the metal casing 2 comprising two facing transverse walls 2A (extending in the transverse and lateral directions) brazed to a bottom wall 2I and a top wall 2S opposite it (extending in the longitudinal and lateral directions), so as to form a peripheral enclosure (or body) of rectangular section, in a known manner. Any other type of section (square, trapezoidal, etc.) is naturally also able to be envisaged. Moreover, the peripheral enclosure could equally be formed from a preassembled, U-section frame and a matching wall joining the two free wings of the frame, or else with two L-pieces.

The transverse walls 2A and the bottom wall 2I and top wall 2S are rectangular in shape so that the casing 2 has a generally parallelepipedal shape.

The perimeter of the transverse walls 2A comprises a peripheral raised rim 16 extending along the longitudinal direction (that is to say at right angles to the corresponding transverse wall 2A).

The bottom lateral portion 16I and top lateral portion 16S of the raised rim 16 of each of the transverse walls 2A serve as a bearing surface to the respectively bottom wall 2I and top wall 2S, for the purpose of the assembly of the peripheral enclosure of the casing 2 by brazing.

Moreover, the bottom wall 2I and top wall 2S of the casing 2 each comprise two longitudinal raised rims 17A and 17B respectively placed at their upstream and downstream lateral ends.

In the example of FIG. 1, the peripheral enclosure has two open faces, upstream and downstream, which extend on either side of the exchanger. The upstream open face is delimited by the upstream transverse portions 16A of the raised rim 16 of each of the two transverse walls 2A, and by the upstream longitudinal raised rims 17A of the bottom wall 2I and top wall 2S. In similar manner, the downstream open face is delimited by the downstream transverse portions 16B of the raised rim 16 of each of the two transverse walls 2A and the downstream longitudinal raised rims 17B of the bottom wall 2I and top wall 2S.

The upstream open face is associated with the inflow of the supercharging gases into the exchanger, while the downstream face is associated with the outflow of these gases from the latter. In other words, these two open faces allow the circulation of the turbocharging gases in the heat exchanger 1.

Designed to be attached to the open faces of the peripheral enclosure of the casing 2 are inlet and outlet manifolds 2B which may take the form of both a cover and of an intake air distributor for the engine and through which the turbocharging gases enter and exit.

The raised rims (16A and 17A; 16B and 17B) delimit the upstream and downstream open surfaces, create bearing surfaces to which the corresponding manifolds 2B are fitted and attached (for example by welding, by brazing or else by flanges).

Moreover, each of the bottom lateral portion 16I and top lateral portion 16S of the raised rim 16 of the transverse walls 2A comprise two auxiliary assembly tabs 18 extending perpendicularly to the longitudinal direction and each formed by cutting of said raised rim 16.

The auxiliary tabs 18 are designed to interact with facing matching apertures 19 arranged in each of the walls, the bottom wall 2I and top wall 2S of the casing 2.

In a known manner, notably for the purpose of providing resistance to the pressure that is exerted on the structure of the heat exchanger 1, the longitudinal end edges 14 of the stacked sheets 4 of the cluster 3 are respectively secured to the two transverse walls 2A of the casing 2 by brazing; more precisely, they are brazed to the internal surfaces of these transverse walls 2A of the casing 2.

The tabs 15 of the edges 14 forming the attachment means are conventionally covered, over the whole of their face turned toward the internal surfaces of the transverse walls 2A, with a brazing material (not shown in the figures) designed for the attachment of the sheets 4 to the internal surfaces of the transverse walls 2A of the casing 2 during the brazing operation.

However, according to the invention, in order to reduce the rigidity of the exchanger 1 and to increase the flexibility thereof, the latter comprises means, known as separation means, for preventing the brazing of the casing 2 of a portion or of the whole of the longitudinal end edges 14 of one or more end sheets 4E of the stack 3, placed on the bottom side 3E and/or top side 3S of the latter.

Thus, the portions or the whole of the edges 14 of the end sheets 4E that are unattached are not secured to the casing 2 at said portions of edges 14 which gives the exchanger 1 a relaxation of the stresses in these zones of the end sheets 4E.

In consequence, the absorption of the mechanical stresses by the end sheets 4E is improved, which limits the risk of fatigue of the structure of the exchanger 1.

A particular embodiment proposes that it is all of the longitudinal end edges 14 of the sheets of the stack 3 that are not secured to the casing 2 of the heat exchanger.

In the embodiment described, the separation means are arranged in order to cause a separation of the casing 2 from the two longitudinal end edges 14 of the two bottom and top end sheets 4E of the stack 3 over the whole of their length. In other words, two end sheets 4E, of the top and bottom sides of the exchanger, are involved in the separation from the casing 2 along the whole of their two edges 14 (on either side of the length of the exchanger).

Naturally, as a variant or in addition, it is possible to envisage:

- that the separation means cause only a partial separation of one or more portions (but not the whole) of each of the edges of the end sheets; and/or
- that the edges of the end sheets are separated from the casing on only one or on both sides (longitudinal and/or top and bottom) of the exchanger; and/or
- that one or more end edges of one and the same side (bottom or top) of the stack are involved in the separation.

In the embodiment shown, the individual connecting plates 5R, previously described, are not considered to be end edges 4E within the meaning of the present invention and are blazed to the casing; in this instance, each connecting plate 5R is not combined with another plate to form a sheet 4 and its function is mainly structural.

Figure 2:
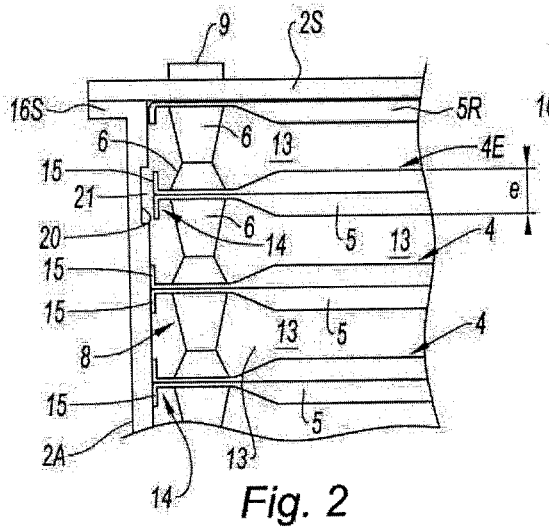
FIG. 2 is a partial, longitudinal, schematic view in section of the assembled exchanger of FIG. 1 illustrating the separation of the end sheets of the heat-exchange cluster.

In the example of FIGS. 1 and 2 according to the preferred embodiment of the invention, the separation means comprise internal rectilinear grooves 20 (four in number in the present example), extending in length in the lateral direction along the edge 14 of the corresponding end sheet 4E. These internal grooves 20 are arranged in the internal surface, that is to say the surface turned toward the cluster 3, of the transverse walls 2A of the casing 2. They are also placed facing corresponding longitudinal end edges 14 of the two end sheets 4E.

The length of the grooves 20, defined in the lateral direction, is advantageously greater than the width of the end sheets, but it could quite obviously be otherwise (for example equal to or less than).

Moreover, although it may be different therefrom, the width of the internal grooves 20, defined in the direction of the stack, is advantageously greater than the width of the means for attaching the edges 14 of the end sheets 4E.

Thus, each groove 20 forms a clearance 21 between the transverse wall of the casing 2 and the facing edge 14 of the corresponding end sheet 4E, which prevents any securing by brazing of this edge 14 to the transverse wall 2A of the casing 2 that faces it.

The deeper an internal groove 20 of a transverse wall 2A is, the greater the clearance 21 arranged between the corresponding edge and this wall 2A. Preferably, the clearance 21 is at least equal to 0.1 mm.

Figure 3:
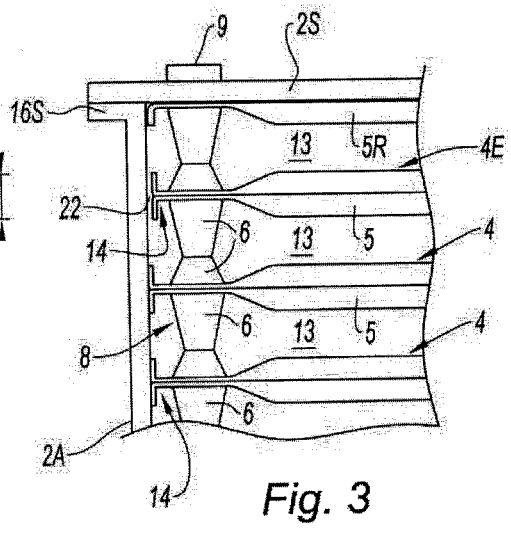
FIGS. 3 to 6 are longitudinal, schematic views in section of exchangers according to second, third, fourth and fifth embodiments of the present invention.

In the example of FIG. 3, according to a second embodiment of the invention, the length L of each of the two end sheets 4E is less than that of the other sheets 4. For example, the length L of the end sheets 4E may be such that a clearance 22 of 0.1 mm is formed between each of their longitudinal end edges 14 and the corresponding facing transverse wall 2A.

In a manner similar to the clearance 21 arranged by the internal grooves 20, the clearance 22 obtained by arranging the end sheets 4E of shorter length prevents any brazing of the edges 14 of these sheets 4E to the casing 2.

Figure 4:
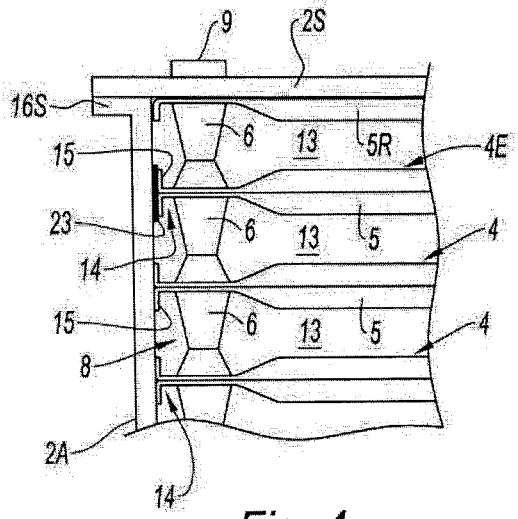

Moreover, in the example of FIG. 4, according to a third embodiment of the invention, the separation means comprise strips of unbrazable material 23. These strips 23, placed on the face of the transverse walls 2A, turned toward the cluster 3, advantageously take the form of a thin film of material. For example, it is possible to use transparent paper adhesive tape, called "tiro" self-adhesive tape or else called coachbuilder adhesive tape.

Each unbrazable strip 23 can be defined by a length and a width.

Alternatively, the unbrazable strips 23 could be placed on the plates 5 concerned.

Thus, during the operation for brazing the cluster 3 of sheets to the casing 2, the edges 14 of the end sheets 4E facing such strips 23 of unbrazable material are not brazed to the corresponding transverse wall 2A, since said strips 23 prevent any brazing.

It will be noted again that it is clearly possible to envisage using one or more portions of strip of nonbrazable material facing one and the same end-sheet edge, so that the portions of the edge facing the portion or portions of unbrazable strip remain free from the corresponding transverse wall after the brazing operation. In the latter case, the heat exchanger has a relaxation of the stresses at the portion or portions of edges that are unbrazable and free from the casing.

Figure 5:
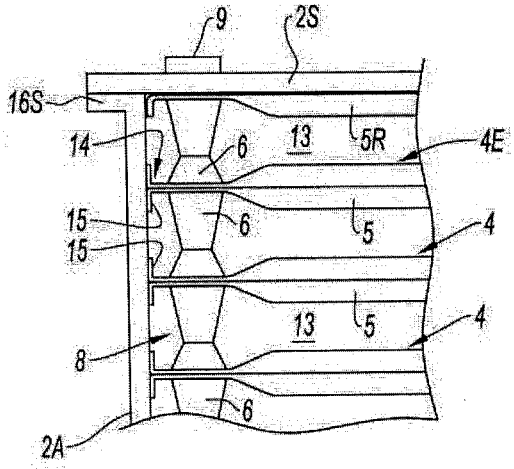

In the example of FIG. 5, according to a fourth embodiment of the invention, the attachment tabs 15 of the edges 14, forming means of attachment to the casing 2, are not covered with a brazing material, so that no brazing of these tabs 15 to the corresponding transverse wall 2A facing them can be obtained during the operation for brazing the exchanger 1.

Those skilled in the art choose between the third and the fourth embodiment depending on the ease of industrial application of one or the other:

in the third embodiment, the plates 5 concerned are formed like the other plates of the exchanger and a strip of unbrazable material is placed elsewhere;

in the fourth embodiment, the plates 5 concerned are formed so as not to be covered with brazing material during the application to them of the brazing material necessary for attaching them to the other elements.

Figure 6:
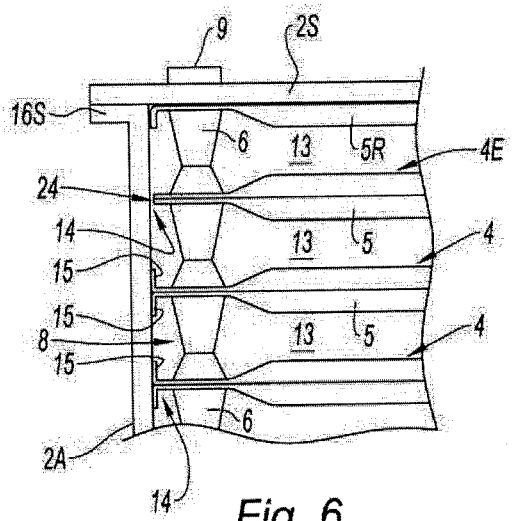

In the example of FIG. 6, according to a fifth embodiment of the invention, the longitudinal end edges 14 of the two end sheets 4E have no means 15 for attachment to the casing 2.

If the brazing material is placed only on the faces of the attachment tabs 15 of the sheet edges 14 (and not on the internal face of the transverse walls 2A), no connection by brazing to the transverse walls 2A of the casing 2 can be obtained because of the absence of brazing material capable of achieving such a connection.

The end sheets 4E with no attachment means may be obtained in any desired manner (cutting of the attachment means from a sheet already fitted with such means, initial manufacture of a sheet with no attachment means, etc.). If there are attachment means 15 already present on the edge 14 of an end sheet 4E, the removal of these attachment means 15 may furthermore cause the formation of a clearance 24 between the edge and the corresponding transverse wall 2A of the casing 2, preventing securing by brazing.

In each of the aforementioned exemplary embodiments, only one type of separation means according to the invention is used. It is clearly possible to combine one or more types of these means in one and the same heat exchanger and even on one and the same plate edge.

Moreover, as has been pointed out above, the present invention is in no way limited solely to the application of cooling heat exchangers for heat engines of motor vehicles and applies more generally to any heat exchanger with a stack of sheets brazed to its casing, irrespective of the fluids circulating therein.

The invention claimed is:

1. A heat exchanger comprising:

a casing;

a heat-exchange cluster, housed in the casing and attached to the casing by brazing, comprising:

a stack of heat-exchange sheets, wherein each heat-exchange sheet of the stack of heat exchange sheets comprises at least one edge for brazing to the casing, and an end sheet;

a separation strip that prevents the brazing onto the casing of at least one portion of an edge of the end sheet of the stack of heat-exchange sheets; and a duct that separates each heat-exchange sheet of the stack of heat-exchange sheets from each other heat-exchange sheet of the stack of heat-exchange sheets, wherein each heat-exchange sheet of the stack of heat-exchange sheets comprises a pair of attachment tabs, wherein each pair of attachment tabs is configured to attach the heat-exchange sheet for brazing to the casing, wherein a first attachment tab of the pair of attachment tabs contacts a second attachment tab of the pair of the attachment tabs, and wherein the duct comprises two bosses of each heat-exchange sheet of the stack of heat exchange-sheets.

2. The heat exchanger as claimed in claim 1, wherein the separation strip is arranged along a whole edge of said end sheet.

3. The heat exchanger as claimed in claim 2, wherein the separation strip is arranged along at least one portion of the edge of a plurality of end sheets, on one and a same side, or on two sides of the stack.

4. The heat exchanger as claimed in one claim 1, wherein the separation strip comprises a clearance arranged between said edge portion of the end sheet and the casing.

5. The heat exchanger as claimed in claim 4, wherein the casing comprises at least one internal groove placed facing said end sheet, said clearance being arranged in said groove.

6. The heat exchanger as claimed claim 1, wherein the sheets have a length perpendicular to the direction of corresponding edges and to the direction of the stack, and wherein the length of the end sheet is shorter than the length of sheets other than the end sheet.

7. The heat exchanger as claimed in claim 4, wherein said clearance is at least equal to 0.1 mm.

8. The heat exchanger as claimed in claim 1, wherein the separation strip comprises a strip of unbrazable material arranged on said casing, the strip being oriented towards said cluster of sheets and placed facing said portion of edge of said end sheet.

9. The heat exchanger as claimed in claim 1, wherein the edge portion of each of the sheet lacks brazing material.

10. The heat exchanger as claimed in claim 1, wherein the sheets comprise, along at least certain edges, tabs or lips configured to contact the casing for being brazed to the latter, wherein said edge portion of said end sheet lacks such tabs or lips.

11. The heat exchanger as claimed in claim 1, wherein each sheet of the stack of heat-exchange sheets comprises the separation strip.

12. A sheet for the heat exchanger of claim 1, the sheet comprising an edge for brazing to the casing, and a separation strip that separates the casing from a portion of the edge.

13. The heat exchanger as claimed in claim 1, wherein each of the two bosses comprises an aperture that is configured to receive a nozzle.

14. The heat exchanger as claimed in claim 1, wherein the pair of attachment tabs contacts an inner wall of the casing.

15. The heat exchanger as claimed in claim 1, wherein a length of the pair of attachment tabs equals to a width of each corresponding sheet.

16. The heat exchanger as claimed in claim 1, wherein:

the casing further comprises two opposing transverse walls, each of the two opposing transverse walls comprises a peripheral raised rim protruding outwardly from a center of the casing.

17. The heat exchanger as claimed in claim 16, wherein the peripheral raised rim comprises an auxiliary assembly tab configured to contact a top wall and a bottom wall of the casing.

18. The heat exchanger as claimed in claim 17, wherein the top wall, the bottom wall, and the two opposing transverse walls are arranged such that the casing is parallelepiped-shaped.

19. The heat exchanger of claim 1, wherein a heat-exchange sheet of the stack of heat-exchange sheets further comprises:

a disruptive boss disposed along a path of fluid flow that disrupts a fluid flow within the path of fluid flow.

20. The heat exchanger of claim 19, wherein the disruptive boss comprises:

a raised portion of the heat exchange sheet of the stack of heat-exchange sheets.

21. The heat exchanger of claim 1, wherein the heat-exchange cluster further comprises:

a connecting plate, wherein the connecting plate is attached to the casing.

22. The heat exchanger of claim 21, wherein the end sheet is disposed between the connecting plate and the stack of heat-exchange sheets.

* * * * *